US006123303A

United States Patent [19]

Huang

[11] Patent Number: 6,123,303

[45] Date of Patent: Sep. 26, 2000

[54] RETRACTABLE BRACKET STRUCTURE

[76] Inventor: Robert C. Huang, 5F, No. 34, Sec. 1, Nanking E. Rd., Taipei, Taiwan

[21] Appl. No.: 09/065,533

[22] Filed: Apr. 24, 1998

[51] Int. Cl.[7] ..... A47G 29/02

[52] U.S. Cl. ..... 248/241; 211/90.02

[58] Field of Search ..... 248/241, 235, 248/250; 211/90.02; 108/108

[56] References Cited

U.S. PATENT DOCUMENTS

| | | | |
|---|---|---|---|
| 1,702,937 | 2/1929 | Friedemann | 248/250 X |
| 4,669,692 | 6/1987 | Mastrodicasa | 248/250 |
| 5,069,408 | 12/1991 | Bessinger | 248/250 |

FOREIGN PATENT DOCUMENTS 216011 11/1993 Taiwan .

*Primary Examiner*—Ramon O. Ramirez

*Attorney, Agent, or Firm*—Rosenberg, Klein & Lee

[57] ABSTRACT

The subject matter relates to the presentation of a type of retractable bracket structure, said bracket being comprised mainly of a main support plate and a retractable plate, wherein the main support plate has a long slide hole, after the retractable plate is saddled on the main support plate, it will be smoothly pulled or pushed to a certain length to suit the width of the placement plate to be installed, then a tightening piece is pulled through the long slide hole to tighten it and accomplish the assembly of the entire retractable bracket, which can be applied widely to various types of placement structures. On the main support plate and the retractable plate can be dents and there may be the production of snap pieces, on the top and bottom sides of said snap pieces are respectively hook pieces and splits, to hook onto the placement plate before it is mounted and positioned on the bracket, so designed that the assembly and disassembly between the placement plate and the bracket are made easy, comfortable, rapid and with better freedom.

3 Claims, 6 Drawing Sheets

RETRACTABLE BRACKET STRUCTURE

BACKGROUND OF THE INVENTION

The subject matter relates to a type of bracket structure, particularly to a type of innovated design of "retractable bracket structure" that can be applied to various types of placement racks or display racks, comprising at least two parallel racks for the positioning of a placement plate, with its length adjustable to suit the different widths of the placement plate, with the attachment of several special fixing snap pieces.

Conventionally, regular types of display rack or placement rack for the display or placement of articles are basically composed of two or more parallel bars that are mounted horizontally on main support posts before a placement plate is put on them, and though the construction and configurations of respective racks may be different, their lengths are fixed and could not be adjusted, the result is that the width of different placement plates could not be matched to the same length of the rack, so it's limitation to a one-to-one basis has caused increased costs on the design, procurement of materials, production and assembling process, and replacement is inevitable in case their measurements are not compatible, so it causes much trouble and inconvenience.

Besides, a conventional placement plate is put flatly and directly onto the supporting posts, where the weight of the placement plate or the weight of the articles thereon will keep it in position, but they would easily fall off and down due to vibration because of lack of proper fixation, therefore, most modern placement racks are tightened by screws, but such assembly and fixation by means of screws will be time and labor-consuming during its assembly, disassembly or even transportation process, furthermore, the placement plate structure would often be damaged, so it is not so satisfactory; moreover, there has been a type of bracket structure developed by the manufacturers, whereby there are snap pieces and hooks to hook onto the snap holes on the placement plate, but the snap pieces are riveted onto the rack, so the locations for the snap pieces on the placement plate must be precisely matched, or else they could never be tightened in position in case there is any slight error, so its assembly process is sophisticated and it is impossible to make quick and easy adjustments, and it lacks applicability, these are shortcomings that need to be addressed.

In view of this, the subject inventor has tried repeated test productions, based on several years of professional research and manufacture and marketing practices in various types of placement racks, and has finally developed a type of retractable bracket structure with effective improvement of the adaptability and convenience in assembly processes.

SUMMARY OF THE INVENTION

The primary objective of the subject matter is to present a type of retractable bracket structure, characterized in that said support rack is composed of a main support plate and a retractable plate that can be moved mutually, and that the length of the integrated rack may be adjusted freely depending on the width of the placement plate, so that it will have multiple applications, thus it will reduce the production and marketing costs for the manufacturers and provide free adjustment to the users.

Another objective of the subject matter is to present a type of retractable bracket structure, characterized mainly in the design of dents on the main support plate of the bracket and on the upper edge of the retractable plate, with additional production of snap pieces that may be hooked onto the placement plate in advance, so that the splits below the snap pieces will be clasped onto the dents of the main support plate or the plate body, to enable rapid and easy assembly of the placement plate onto the bracket.

To enable further understanding of the objectives, characteristics and advantages of the subject matter, the embodiment of the subject matter is described in detail accompanied by drawings below:

BRIEF DESCRIPTION OF NUMERALS

| | | | |
|---|---|---|---|
| 1 | placement plate | 10 | snap hole |
| 11 | hanging hook | | |
| 2 | bracket | 20 | main support plate |
| 200 | snap piece | 201 | stop piece |
| 202 | fixing piece | 203 | long slide hole |
| 204 | dent | 21 | retractable plate |
| 210 | stop plate | 211 | screw hole |
| 212 | tightening piece | 213 | dent |
| 3 | snap piece | 30 | hook piece |
| 31 | clasp piece | 310 | split |

DETAILED DESCRIPTION OF PREFERRED EMBODIMENT

Figure 1:
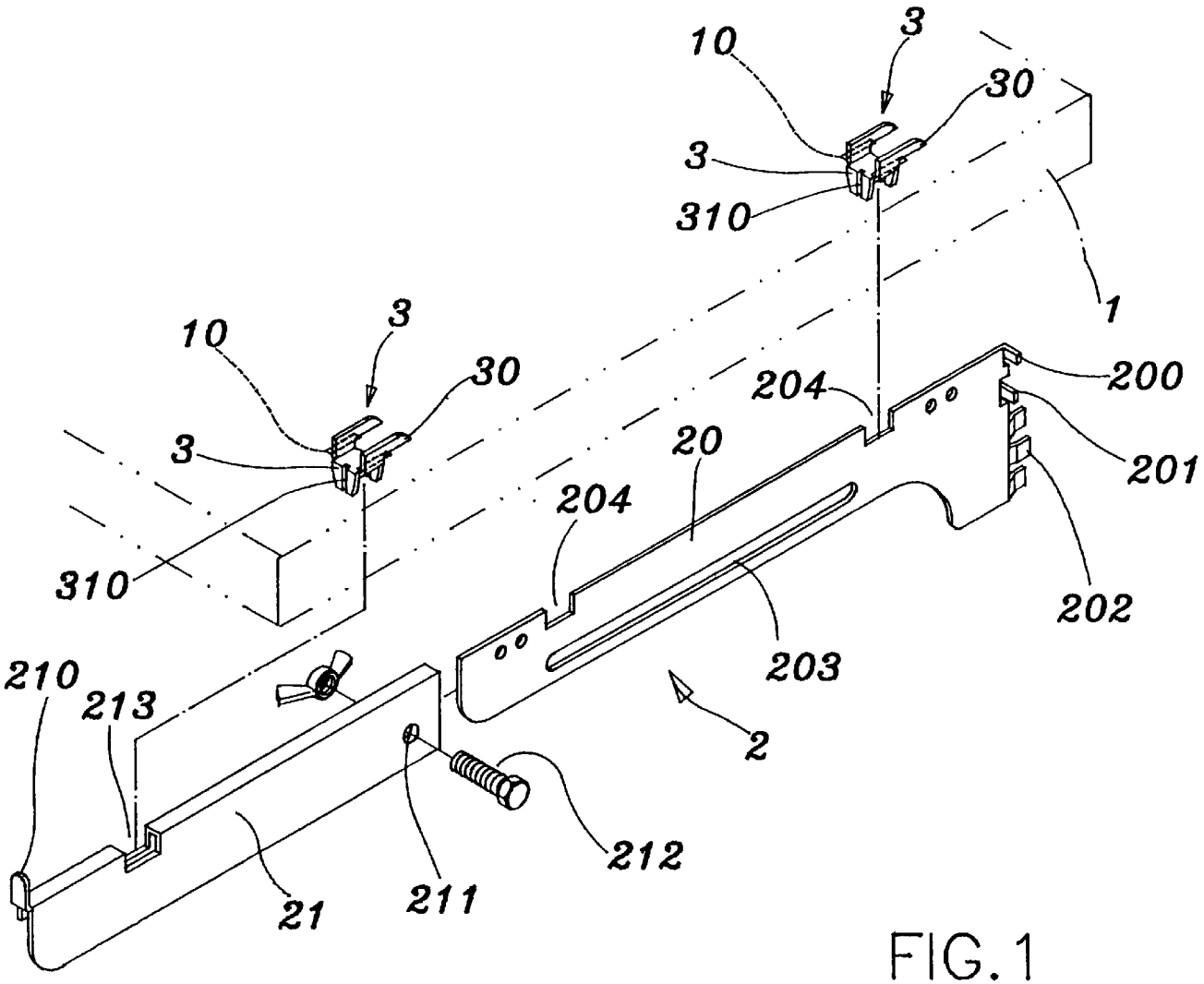
FIG. 1 is an exploded view of the subject matter.
Figure 2:
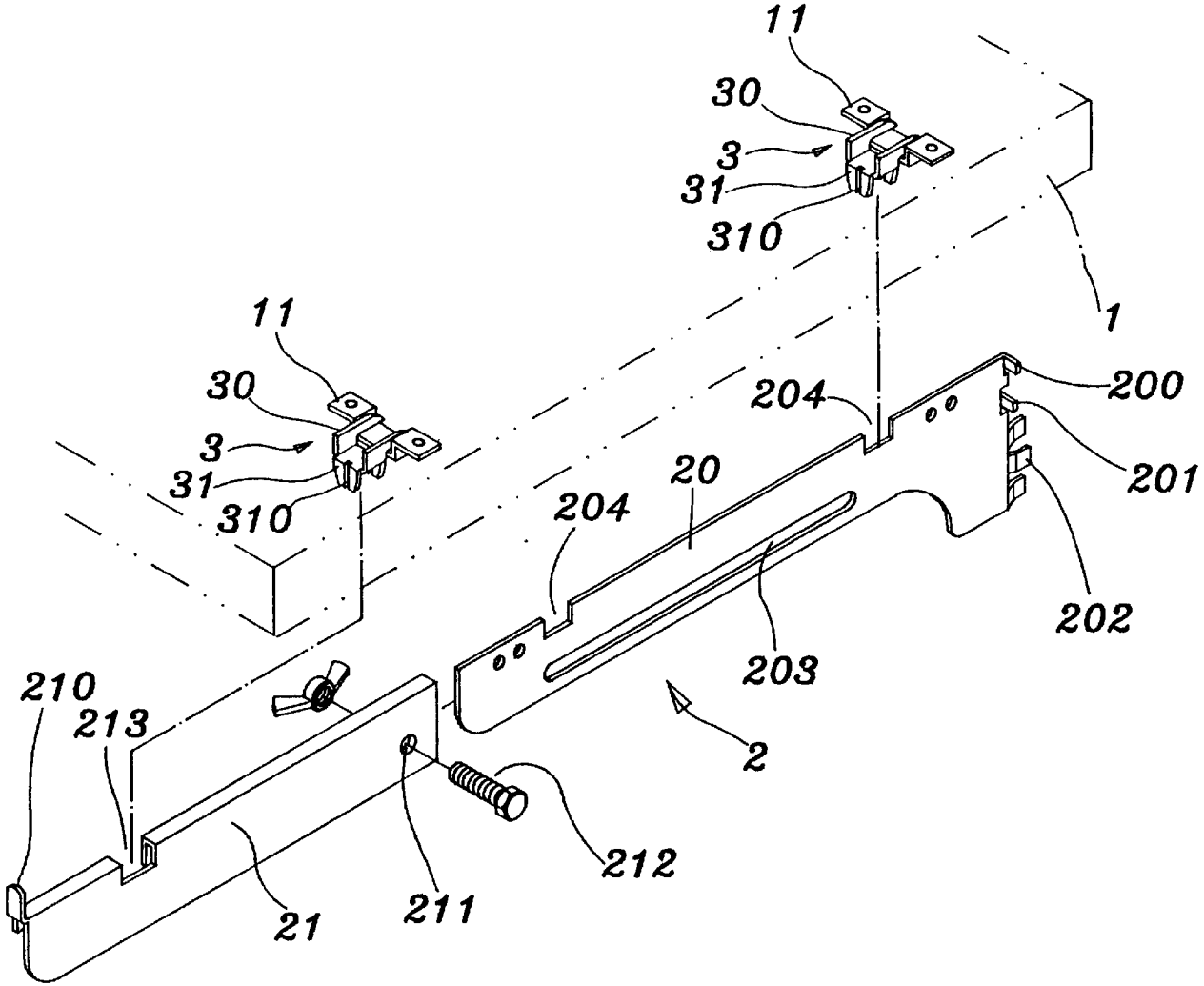
FIG. 2 is an exploded view of another assembly of the subject matter.
Figure 3:
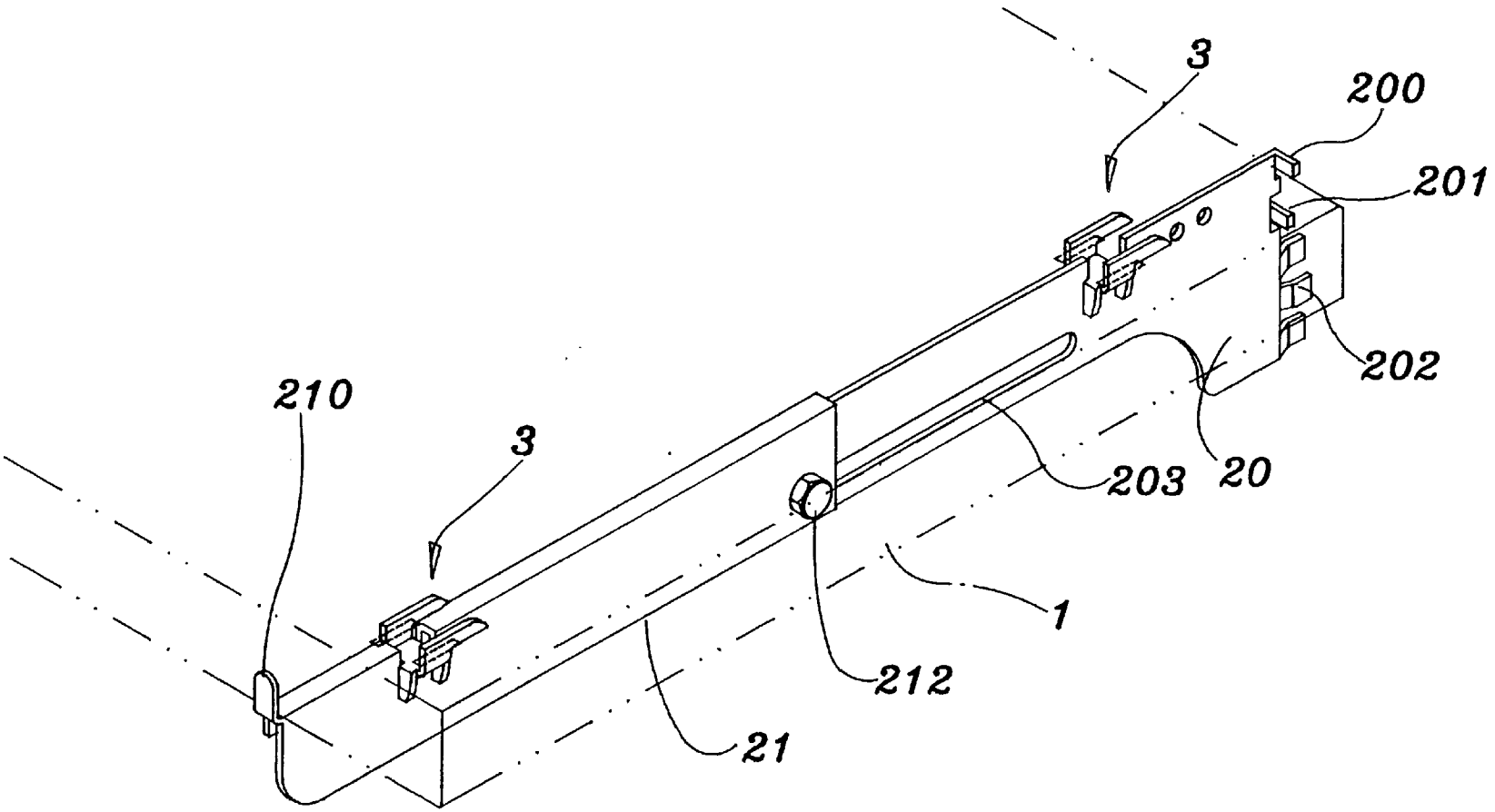
FIG. 3 is a perspective assembled view of the subject matter.

Referring to FIGS. 1 to 3 which illustrate a preferred embodiment of the subject matter of retractable bracket structure, involving such components as a placement plate 1, a bracket 2 and a specified number of snap pieces 3 to fix the placement plate 1 onto the bracket 2, wherein the bracket 2 is composed of a main support plate 20 and a retractable plate 21;

One end of the main support plate 20 of the bracket 2 is joined to the main support post of the placement rack, the joining components include the outside protruding snap piece 200, inside protruding stop piece 201 which are located on the left and right and extending sideways from up to down on the end edge, and the fixing piece 202 that protrudes and extends outward, with the snap piece 200 and the stop piece 201 to clasp the groove wall of the hook groove of the main support post on the inside and outside, and by inserting the fixing piece 202 in the hook groove, so that said main support plate 20 will simultaneously be positioned securely from all sides (its structure has been fully disclosed in the Taiwan Patent publication entitled, "Bracket Positioning Structure", Publication No. 216011, for which the subject inventor had filed the application and which patent right has been approved, so it requires no elaboration here); in the plate body of the main support plate 20 is a long slide hole 203 which extends lengthwise, on the upper edge of the plate body are another two dents 204, such are the construction of the main support plate 20.

The section of the retractable plate 21 of the bracket 2 is in a reversed "L" shape, protruding upwards on its end is a stop piece 210, on its front end is a screw hole 211 that serves to be tightened by a tightening piece 212 (a bolt is used in the subject embodiment), and on the upper edge near the outside of the plate body is another dent 213, but its groove depth shall be equivalent to the total of the groove depth of the dent 204 of said main support plate 20 and the thickness of the top side of said retractable plate 21, so that when the two snap pieces 3 are respectively snapping, the top side of said two snap pieces 3 can be maintained at an imaginary level surface, to enable steady positioning of the placement plate 1.

The snap piece 3 is integrally formed with its two wing-shaped hook pieces 30 bent upwards and the clasp pieces 31 with a slip 310 on the front and rear bent down, in actual use, the hook piece 30 is hooked to the snap hole 10 on the bottom side of the placement plate 1 (a hollow plate or the like, as shown in FIG. 1) or hooked to the ""-shaped hanging hook 11 (a solid plate or the like, as shown in FIG. 2), and then inserted to the bracket 2.

First, when the end structure of the main support plate 20 is joined to the main support post, the retractable plate 21 can be saddled on the main support plate 20, with the screw hole 211 aligned to the long slide hole 203 of the main support plate 20, then tightened by the tightening piece 212, then the retractable plate 21 is pulled or pushed in contrast to the main support plate 20 to the extent that the length of the entire bracket 2 is equivalent to the width of the placement plate 1, then the placement plate 1 with fixed snap piece 3 is placed onto it, while the split 310 of the snap piece 3 snaps into the dent 204 of the main support plate and the plate body of the main support plate 20 of the dent 213 of the retractable plate 21, so that the retractable plate 21 is trapped and could not move, or as required by actual circumstances the snap piece 3 can be designed on the plate body instead of the dent of the main support plate 20 to slide to the front or rear properly, so the placement plate 1 can be securely joined to the bracket 2, then, only by adjusting the retractable plate 21 to the extent that the stop piece 210 extending to its outside pushes against the outside edge of the placement plate 1, and by tightening the tightening piece 212, the joining and positioning of the integral bracket 2 and the placement plate 1 can be accomplished rapidly.

Figure 4:
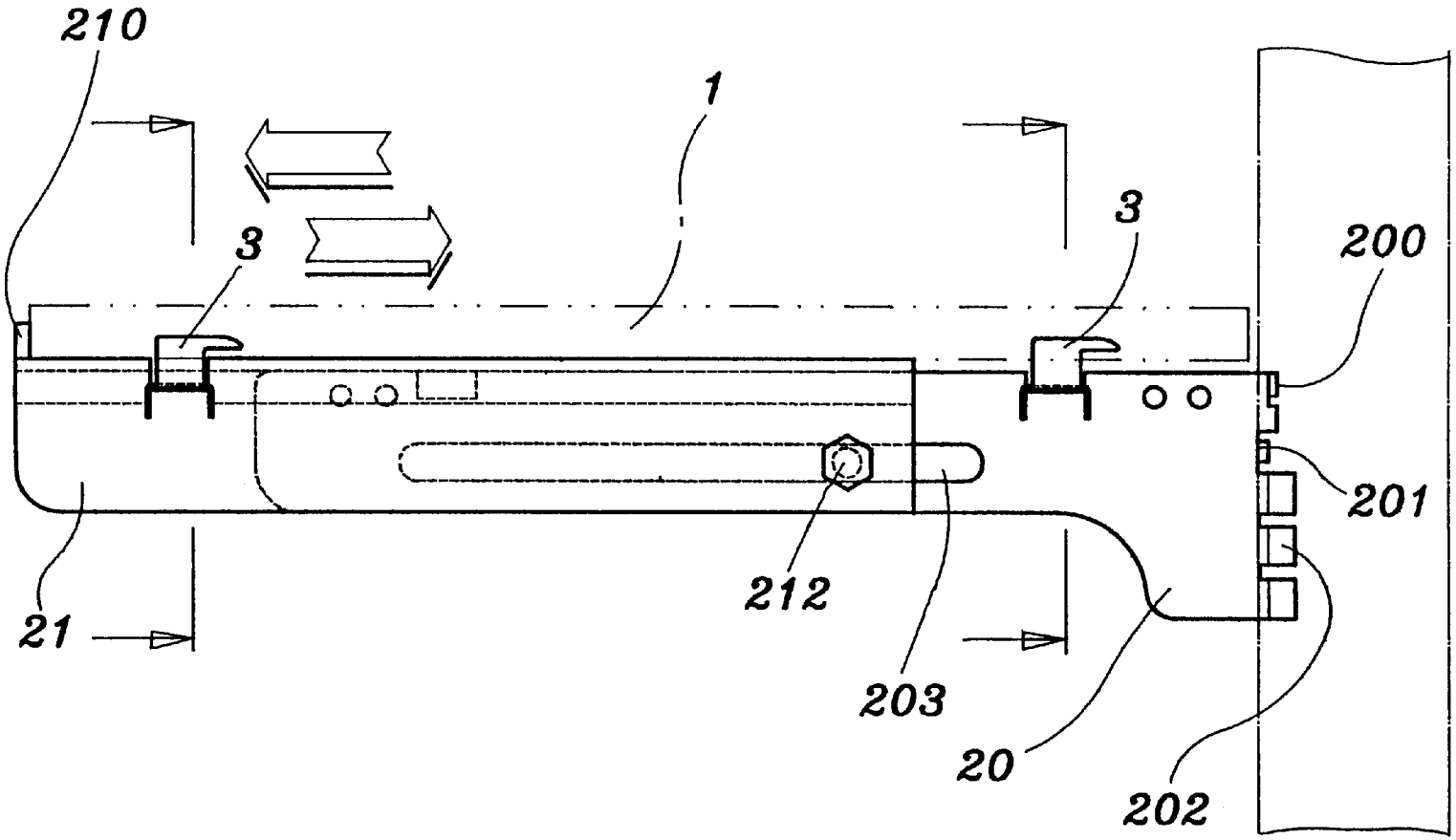
FIG. 4 is a side view of the subject matter in application.

With the design of the push-and-pull connection of the separated main support plate 20 and the retractable plate 21 of the bracket 2, adjustment can be made at any time to suit the placement plate 1 of different plate widths (as shown in FIG. 4), that is, a single set of bracket 2 will be applicable to various types of placement plate 1, then again by the use of specially structured snap piece 3, the placement plate 1 and the bracket 2 can be easily assembled or disassembled to save much trouble.

Figure 5:
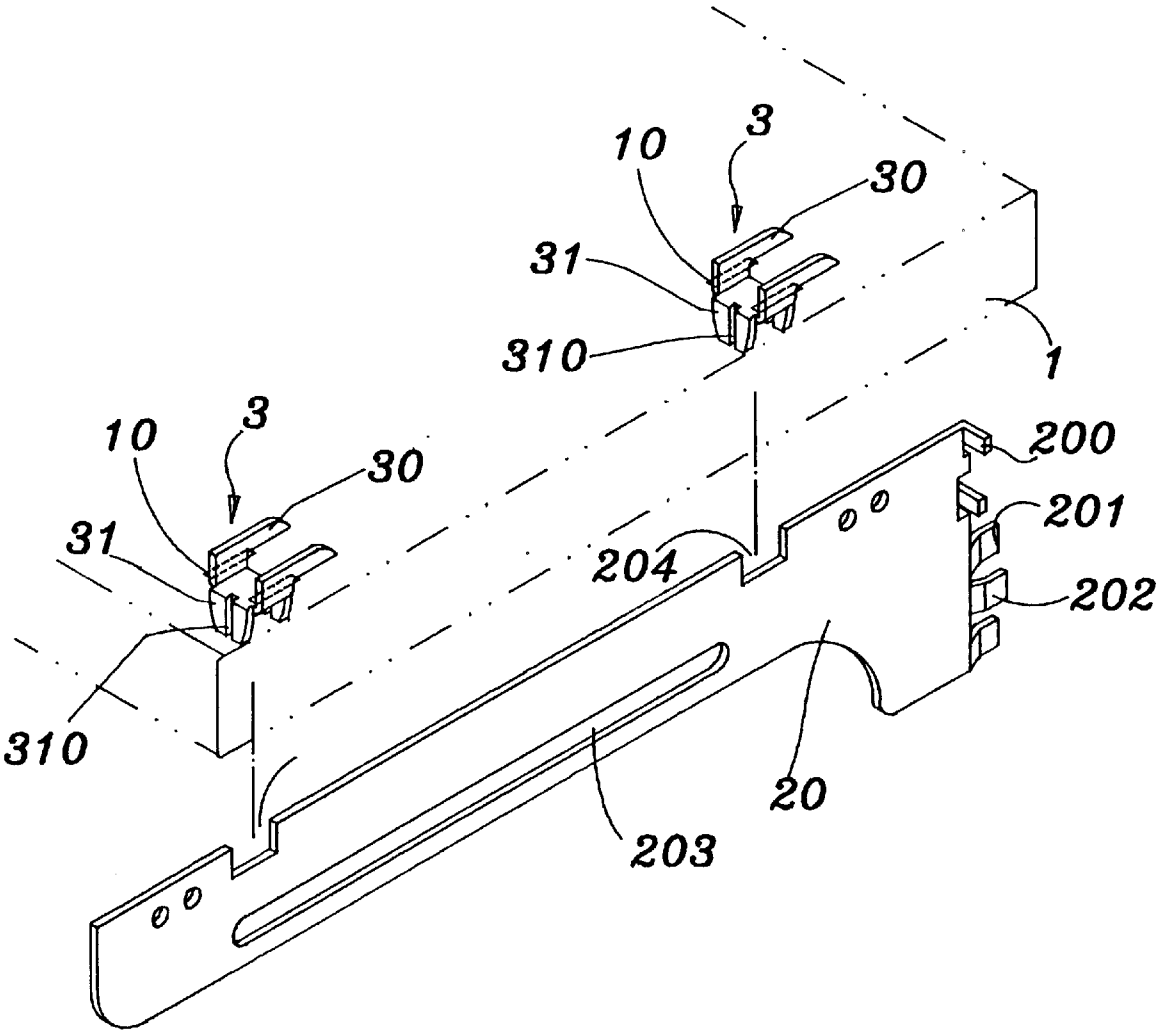
FIG. 5 is a perspective view of another preferred embodiment of the subject matter.
Figure 6:
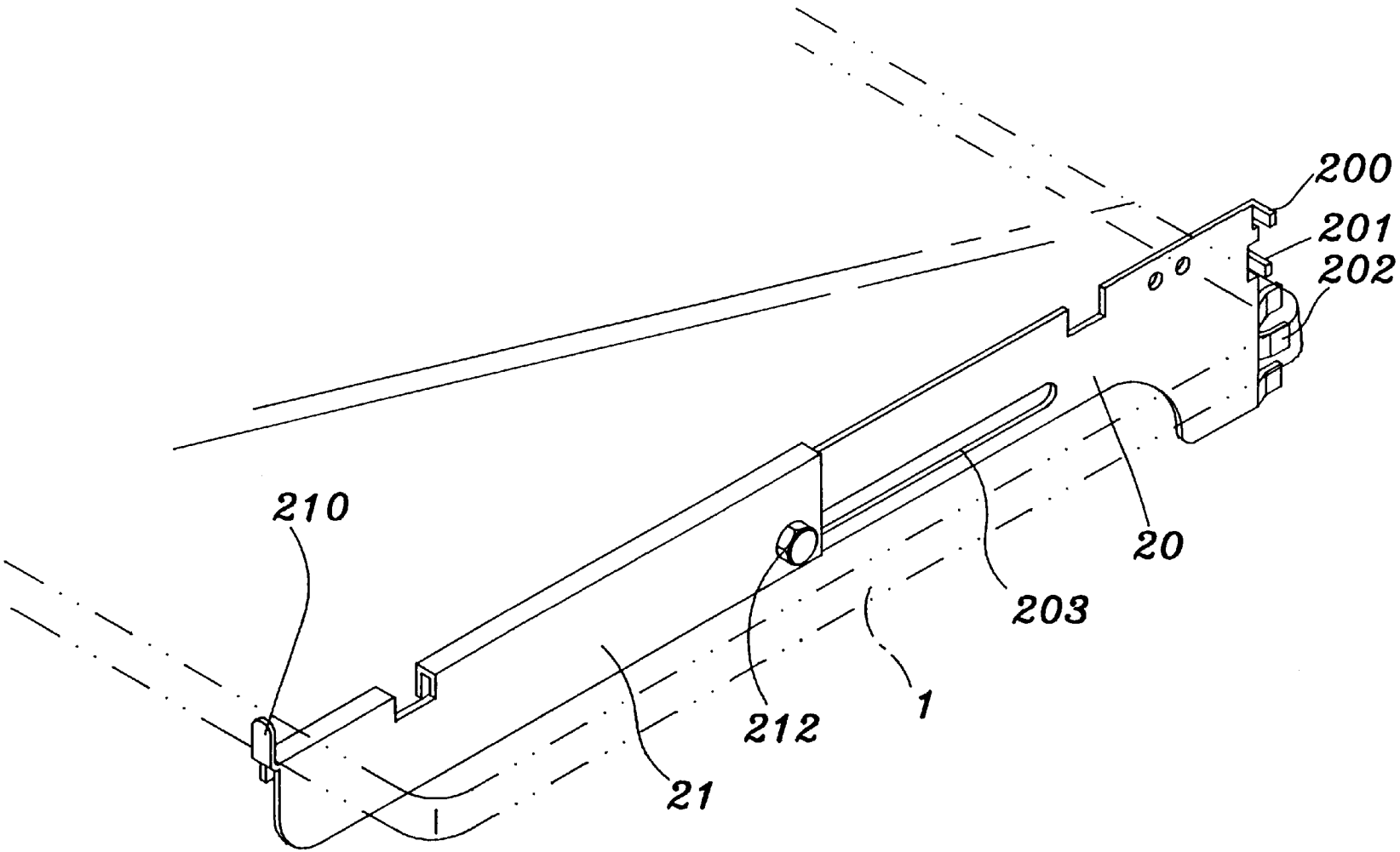
FIG. 6 is a perspective view of yet another preferred embodiment of the subject matter.

Furthermore, as shown in FIG. 5, when the width of the placement plate 1 is not big, only the main support plate 20 and the snap piece 3 can be composed, and the single placement plate 1 can be mounted onto the main support plate 20 by means of the snap piece 3; or in case the placement plate 1 is a glass plate or other plate bodies to which the snap hole 10 and the attachment of hanging hook 11 are not possible (as shown in FIG. 6), the main support plate 20 and the retractable plate 21 will be sufficient to jointly support and position the placement plate 1 without the need of the snap piece 3.

Summing up, the subject matter of retractable bracket structure can be applied widely to the placement structure of all types and kinds, and with easy assembly and disassembly processes, its applicability and originality are without doubt, meanwhile, the subject matter has never be seen in similar products or in public use, nor is it disclosed in any publications before the subject application, therefore it has satisfied the requirement of novelty, hence this application is filed in accordance with the Patent Law to protect the subject inventor's rights and interests. Your favorable consideration shall be appreciated.

It is hereby declared that the above description, covering only the preferred embodiment of the subject matter, should not be based to limit or restrict the subject claim, and that all equivalent structural and/or configurational variations and/or modifications easily conceivable to anyone skilled in the subject art, and deriving from the subject description with drawings herein shall reasonably be included in the intent of the subject claim.

I claim:

1. A retractable bracket for coupling to a main support post of a placement frame to support a placement plate thereon, comprising:

a longitudinally extended main support plate having one end thereof adapted for joining to the main support post, said main support plate having a longitudinally slotted opening formed therethrough;

a retractable plate having a portion thereof disposed along a side of said main support plate and being slidably coupled to said main support plate, said retractable plate having a hole formed therethrough in aligned relationship with said slotted opening and a treaded fastener extending through said slotted opening and said hole for releasable of said retractable plate to said main support plate; and, a plurality of snap pieces respectively engageable on said main support plate and said retractable plate, each said snap piece having hook pieces on an upper side thereof for coupling with apertures in a lower side of the placement plate, each said snap piece having a plurality of clasp pieces extending from a lower portion thereof with splits therebetween for coupling to a respective one of said main support plate and said retractable plate subsequent to coupling of said snap pieces to the placement plate.

2. The retractable bracket structure, as recited in claim 1, wherein said main support plate and said retractable plate each have at least one indentation formed therein for respectively positioning said snap pieces therein.

3. The retractable bracket structure, as recited in claim 2, wherein a depth dimension of said at least one indentation in said retractable plate is equal to the sum of a plate thickness of a top side of said retractable plate and a depth dimension of said at least one indentation in said main support plate.

* * * * *